US006600407B2

(12) United States Patent
Paek

(10) Patent No.: US 6,600,407 B2
(45) Date of Patent: Jul. 29, 2003

(54) RECORD MEASUREMENT METHOD AND SYSTEM USING RADIO FREQUENCY IDENTIFICATION

(75) Inventor: Min-ho Paek, Seoul (KR)

(73) Assignee: Speedchip Co., Ltd., Seoul (KR)

( * ) Notice: Subject to any disclaimer, the term of this patent is extended or adjusted under 35 U.S.C. 154(b) by 0 days.

(21) Appl. No.: 09/907,640

(22) Filed: Jul. 19, 2001

(65) Prior Publication Data

US 2002/0008624 A1 Jan. 24, 2002

(30) Foreign Application Priority Data

Jul. 20, 2000 (KR) ..... 2000-20699
Apr. 14, 2001 (KR) ..... 2001-20040

(51) Int. Cl.[7] ..... G08B 23/00

(52) U.S. Cl. ..... 340/323; 340/933; 340/941; 340/825.69; 340/825.72

(58) Field of Search ..... 340/323, 933, 340/941, 825.69, 825.72

(56) References Cited

U.S. PATENT DOCUMENTS 5,131,020 A * 7/1992 Liebesny et al. ..... 340/905
5,436,611 A * 7/1995 Arlinghaus, Jr. ..... 340/323 R
5,663,717 A * 9/1997 DeLuca ..... 340/825.36
5,671,010 A * 9/1997 Shimbo et al. ..... 348/157
5,696,481 A * 12/1997 Pejas et al. ..... 340/323 R
5,812,049 A * 9/1998 Uzi ..... 340/323 R
6,055,413 A * 4/2000 Morse et al. ..... 340/825.44

* cited by examiner

*Primary Examiner*—Daniel J. Wu
*Assistant Examiner*—Hung Nguyen
(74) *Attorney, Agent, or Firm*—Leydig, Voit & Mayer, Ltd.

(57) ABSTRACT

A record measurement system includes a record collecting apparatus in which an antenna array generates a wireless power signal at a predetermined measurement point, receives an identification (ID) signal output from an antenna tag attached to a person to be measured and driven by the wireless power signal at the measurement point, and determines and outputs the received ID and a passing time record at the measurement point; a database where the ID of each antenna tag, personal data of the person to be measured having the ID, and a passing time record at the measurement point, which are determined and transmitted by the record collecting apparatus, are stored; and a management server for storing the personal data and record data determined and transmitted by the record collecting apparatus in the database or reading out and transmitting the personal data and the passing time record stored in the database.

15 Claims, 5 Drawing Sheets

RECORD MEASUREMENT METHOD AND SYSTEM USING RADIO FREQUENCY IDENTIFICATION

BACKGROUND OF THE INVENTION

1. Field of the Invention

The present invention relates to a record measurement method and system, and more particularly, to a record measurement method and system using radio frequency identification for informing a participant having a race of a race record or expected passing/arrival time during the race or just after the race is completed through a mobile phone of the participant.

Also, the present invention relates to a record measurement method and system using radio frequency identification for identifying an object passing a particular area in a wireless manner and simultaneously processing image data photographed by an image signal receiving apparatus, for example, an analog or digital camera, and using and managing the processed data, by using an ID signal of an antenna tag as well as image data.

2. Description of the Related Art

As a 5 km or 10 km mini marathon, a half course marathon, a 42.195 km full course marathon, a walking race, and a bicycle race become gradually popularized, accurate measurement of records and rapid notification of the measured records are needed. Accordingly, the present applicant filed a Korean Patent Application No. 98-53311, entitled "Electronic Record Measurement Method And System Using Radio Frequency Identification", on Dec. 5, 1998. According to the invention disclosed in the above application, each participant of a race is provided with an ID and an antenna tag having the ID is attached to the shoes of the participant. The participant is identified by way of wireless communications between the antenna tag and an antenna array installed at each lap of a race course, and record data of the participant is transmitted and stored. Thus, records of a plurality of participants having a race can be measured accurately within a short time. Also, the record data is input to database so that the participants can check one's data through the Internet or by making a telephone call to a host organization.

However, since the above-described method requires the participant or others to access the Internet or make a telephone call to the host organization, it is inconvenient to prepare environment for Internet access or telephone communications and input security data such as personal data or necessary materials. Also, it is a demerit for one who looks up the record data to pay for the Internet access or telephone calls.

Also, an antenna tag is used as one of conventional RF identification apparatus. That is, a tag having a intrinsic identification number and transmitting an ID signal is attached to an object to be identified such as a person or bicycle and an apparatus including an antenna capable of identifying the tag is installed at a predetermined position. When the person or an object passes the predetermined position, the apparatus receives the ID signal transmitted from the tag attached to the person or bicycle and identifies the person or bicycle.

In another example of the identification apparatus, an infrared sensor is used to identify an object. When the object is identified, an image apparatus is operated to record image information.

Although the identification apparatus using the antenna tag may accurately identify a tag itself, since determination of an actual identified object itself may not be correct, there is a limit in the type of an object to be identified and the range of RF identification Also, in the image information recording apparatus using an infrared sensor, since even an undesired object such as animal is photographed and unnecessary information is stored, it takes rather long time to analyze and interpret desired information.

SUMMARY OF THE INVENTION

To solve the above-described problems, it is an object of the present invention to provide a service method and system for informing a participant of the race of the record of a race or expected passing/arrival time by automatically transmitting the above information to a mobile phone the participant assigns in advance.

It is another object of the present invention to provide a service method and system for informing a participant of the race of the record of a race or expected passing/arrival time, including advertisement or promotion contents, by automatically transmitting the above information to a mobile phone the participant assigns in advance.

It is yet another object of the present invention to provide an apparatus for identifying an object by matching the ID signal of a tag and an image signal of the object photographed by using an image collecting apparatus such as a camera so that accuracy of identification of an object is improved and necessary information only is stored.

To achieve the above objects, there is provided a record measurement method using RF identification (ID) comprising the steps of determining an ID of a person to be measured and a record of passing time at the measurement point by receiving an ID signal output from an antenna tag attached to the person to be measured which is driven by a wireless power signal generated by an antenna array at a predetermined measurement point, when the person passes or arrives at the measurement point, and receiving the ID signal of each antenna tag, personal data of the person to be measured having the ID, and the passing time record at the measurement point, and storing the received information in database or reading out the personal data and the passing time record stored in the database, and transmitting the data.

It is preferred in the present invention that the method further comprises a step of transmitting a message such as a record data of the person to be measured passing the measurement point by making a telephone call at a number of a mobile phone of the person to be measured by a management server for managing the database.

It is preferred in the present invention that the message is a text message and/or a voice message.

It is preferred in the present invention that, when the message is transmitted, an advertisement or promotion message of a sender is transmitted together.

It is preferred in the present invention that the method further comprises a step of photographing an image of the person to be measured for a predetermined period from the point when the person to be measured passes or arrives at the measurement point, and wherein the management server matches the photographed image and the person to be measured and stores the result in the database.

It is preferred in the present invention that the method further comprises a step of photographing an image of the person to be measured for a predetermined period from the point when the person to be measured passes or arrives at the measurement point, and wherein the management server matches the photographed image and the person to be measured and stores the result in the database.

It is preferred in the present invention that an apparatus for photographing an image is a digital camera or an analog camera.

To achieve the above objects, there is provided a record measurement system comprising a record collecting apparatus in which an antenna array generates a wireless power signal at a predetermined measurement point, receives an identification (ID) signal output from an antenna tag attached to a person to be measured which is driven by the wireless power signal when the person to be measured passes or arrives at the measurement point, and determining and outputting the received ID and a passing time record at the measurement point, a database where the ID of each antenna tag, personal data of the person to be measured having the ID, and a passing time record at the measurement point which are determined and transmitted by the record collecting apparatus are stored, and a management server for storing the personal data and record data determined and transmitted by the record collecting apparatus in the database or reading out and transmitting the personal data and the passing time record stored in the database.

It is preferred in the present invention that the system further comprises a communications modem for transmitting a message of a passing time record of the person to be measured at the measurement point when the management server makes a telephone call at the number of a mobile phone of each person to be measured.

It is preferred in the present invention that the system further comprises an image photographing apparatus for photographing an image of the person to be measured for a predetermined period from a point when the person to be measured passes or arrives at the measurement point, and wherein the management server matches the photographed image and the person to be measured and stores the matched result in the database.

It is preferred in the present invention that the record collecting apparatus comprises an antenna tag for receiving a wireless power signal and wirelessly transmitting a predetermined ID, an antenna array for receiving an ID wireless signal transmitted from the antenna tag, an antenna switching unit for selecting the ID wireless signal through the antenna array, an antenna matching unit for matching impedance between the antenna array and the antenna switching unit, and an antenna multiplex control unit for performing switching by receiving a switching signal of the antenna switching unit and selectively transmitting an ID wireless signal of each antenna tag through the antenna matching unit.

It is preferred in the present invention that, when the image photographing apparatus is a digital camera, the image photographing apparatus photographs an image according to a trigger signal generated by the record collecting apparatus and the photographed image is instantaneously and partially stored by the management server.

It is preferred in the present invention that, when the image photographing apparatus is an analog camera, the image photographing apparatus continuously photographs an image without an additional trigger signal and the photographed image is stored by the management server.

It is preferred in the present invention that an expected passing/arrival time for a particular lap is informed at a certain point in advance based on the previous record.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

In the present invention, a participant in a race such as marathon is assumed as one whose record is to be measured by using radio frequency (RF) identification. Hereinafter, a mobile phone that a participant of a race assigns in advance to receive information means a PCS phone, a cellular phone, an IMT 2000 phone, or a PDA (personal data assistant). However, for the convenience of explanation, it is assumed that a generally used mobile phone is adopted in the following preferred embodiment.

Figure 1:
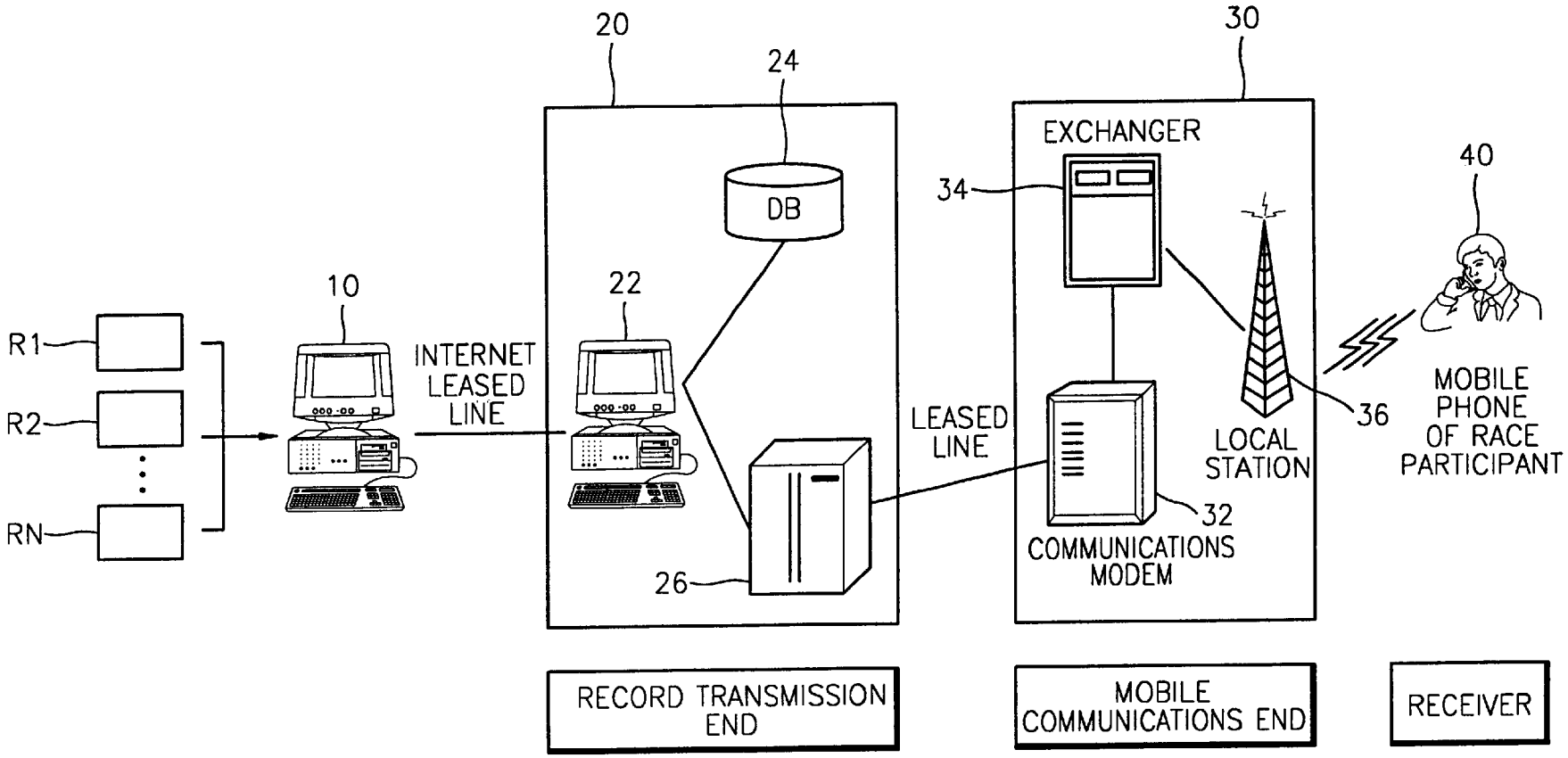
FIG. 1 is a view showing the configuration of a record measurement system using radio frequency identification according to the present invention.

FIG. 1 shows a service system for transmitting record data of a race to a mobile phone as a record measurement system using RF identification according to the present invention. Referring to the drawing, a service system for transmitting record data of a race according to the present invention includes a host computer 20 for managing personal data such as name and mobile phone number of a participant and record of a race in an integrated database, and a telephone office 30 for sending a message of a race record transmitted from the host computer 20 to a mobile phone 40 of the participant. Here, record collecting apparatuses R1–RN are used to smoothly and accurately measure a record of a participant having a race. The structure of the record measurement apparatus is schematically shown in FIG. 2.

Figure 2:
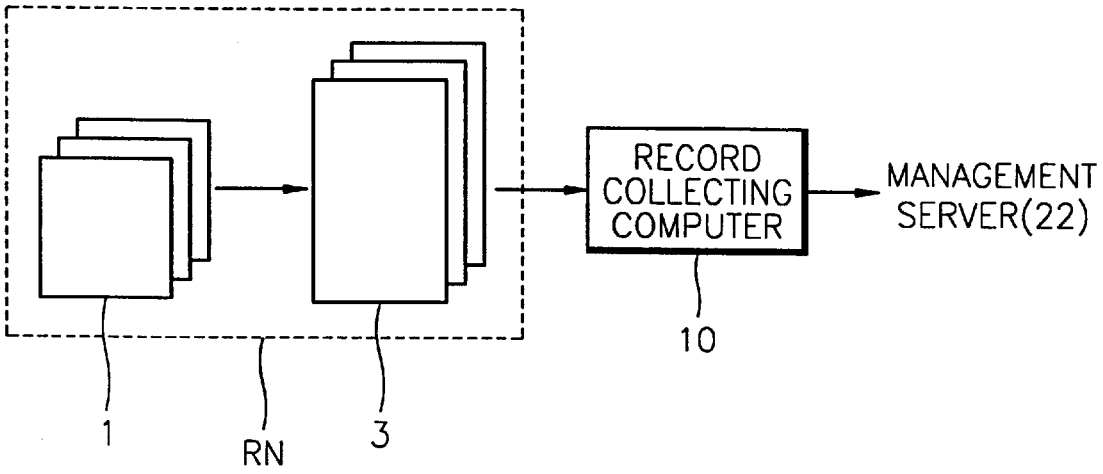
FIG. 2 is a view showing the concept of an electronic automatic record measurement system using radio frequency identification adopted in the present invention.

As shown in FIG. 2, an electronic automatic record measurement system using RF identification adopted in the present invention, as a record collecting apparatus RN, includes an antenna tag 1 attached to shoes of a participant of a race for transmitting an ID signal of the name or mobile phone number of the participant, and an antenna array circuit 3 for measuring and transmitting passing time at a point where the participant wearing shoes to which the antenna tag 1 is attached passes through an RF identification process with the antenna tag 1. The record measured by the above system is collected by a record collecting array circuit 3 and is transmitted to a management server 22 in an integrated database host computer 20 through a public line or a leased line such as a public telephone network or the Internet.

In the present invention, although the record of the participant of a race is transmitted online from the record collecting computer 10 to the management server 22, since online transmission is not compulsory, the collected record data transmitted to the management server 22 can be input to database manually by the management server 22.

In this preferred embodiment, the record data of a participant transmitted to the management server 22 is recorded in database 24 or updated. The database 24 is preferably made up such that record data can be sorted by a participant, a lap or a race. Here, the format of a message to be transmitted is stored and record data is transmitted in the form of a message. The message may be a text message and/or a voice message. In the case of the text message, the message has a particular format which enables change of the name and record of a participant for transmission. In the case of the voice message, the record data is transmitted by being converted to voice. Technologies of transmitting the text message and voice message have been widely used, description thereof will be omitted. However, since a characteristic feature of the present invention does not lies on the above message transmitting technology, but is based on how smooth, fast, accurate transmission of record data to participants in a large size race, in the present invention, a service system and method for transmitting record data to a mobile phone to achieve the technical objective will only be described.

Back to FIG. 1, when record data corresponding to a participant is stored on the database 24, the management server 22 searches and reads out record data of each participant and personal data such as the name and mobile phone number of the participant from the database 24 according to an instruction by an operator and makes a telephone call to a mobile phone of the participant to transmit record data in the form of a predetermined message through a communications modem 26.

The record data message transmitted through the communications modem 26 of the integrated database host computer 20. A telephone call is made at the number of a mobile phone through a communications modem 32 of a telephone office 30. The message transmitted via an exchanger 34 and a local station 36 is stored in a mobile phone 40 of a participant. Then the mobile phone 40 displays the received message.

Figure 3:
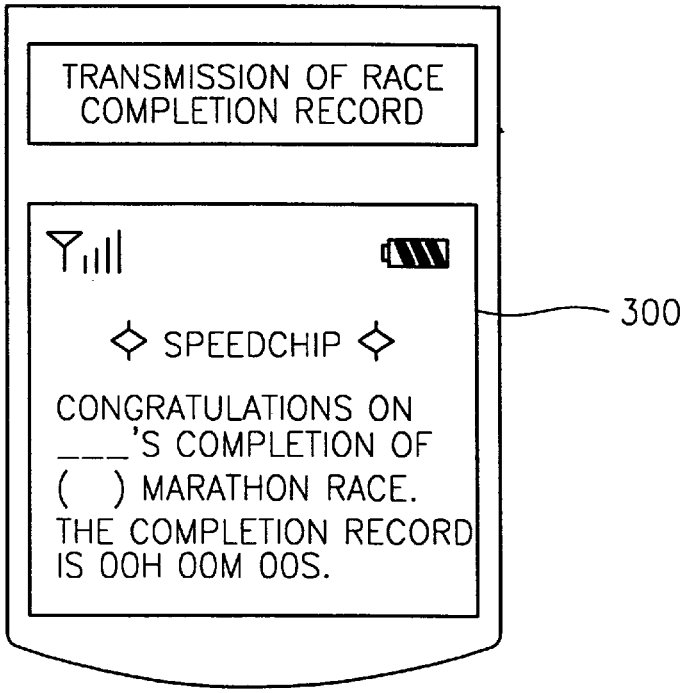
FIG. 3 is a view showing an example of a message displayed on a display of a mobile phone.
Figure 4:
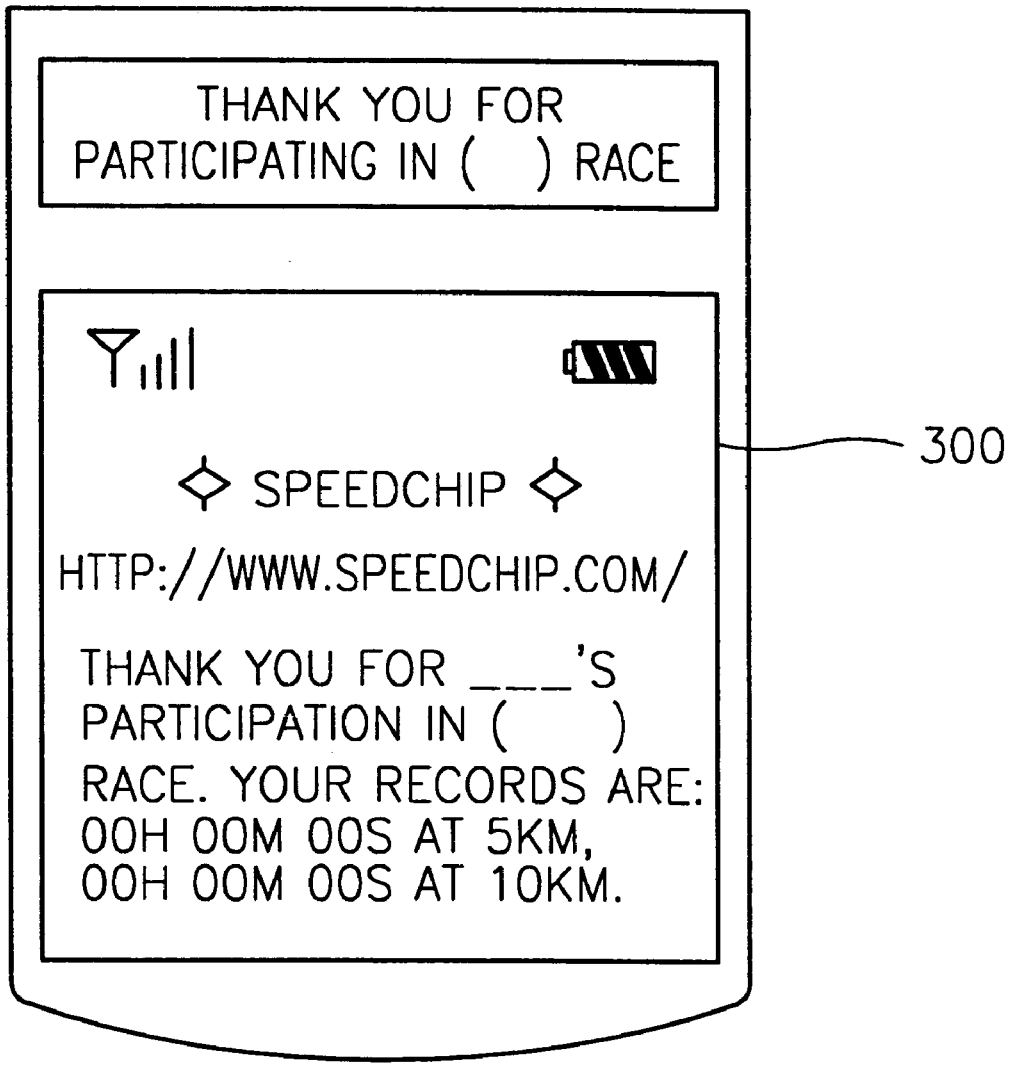
FIG. 4 is a view showing another example of a message displayed on a display of a mobile phone.

FIGS. 3 and 4 show examples of a message displayed on a display of a mobile phone. In FIG. 3, a message of congratulating the completion of a marathon race is displayed together with the completion record of a participant. Also, the name of a sponsor, for example, "SPEEDCHIP", who transmitting the record data can be displayed on part of a screen 300 of a mobile phone. Further, as shown in FIG. 4, the Internet homepage address of the sponsor can be displayed. In FIG. 4, records of a participant by lap is transmitted so that, although the participant has not completed a race, the participant can check his/her lap records.

Figure 5:
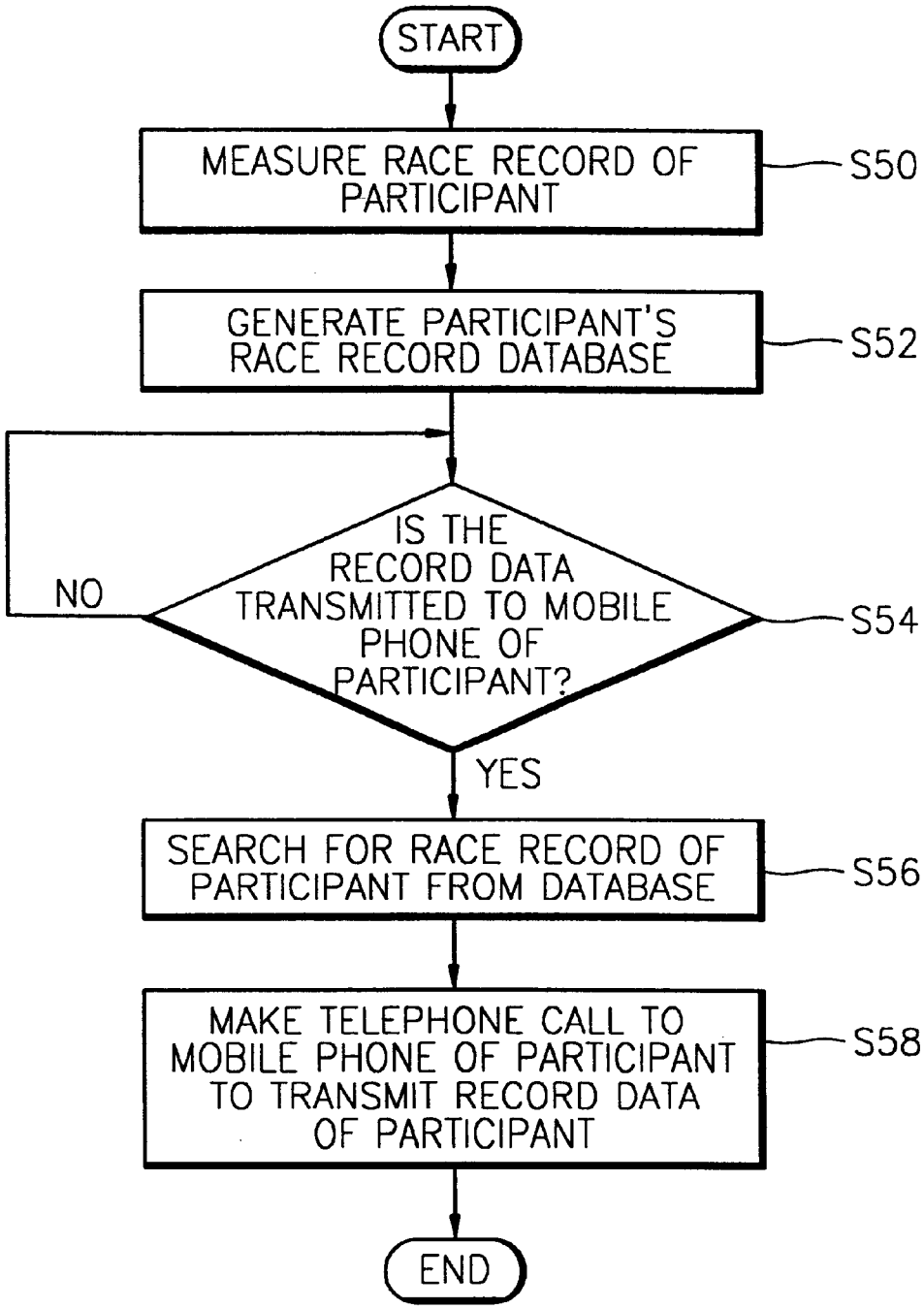
FIG. 5 is flowchart for explaining a record measurement method using radio frequency identification of the present invention.

FIG. 5 is a flowchart for explaining a service method for transmitting race record data to a mobile phone as a record measurement method using RF identification of the present invention. As shown in FIG. 5, first, a race record of a participant is measured S50. Here, a technology of measuring passing time by way of RF identification between an ID antenna tag and an antenna array to identify a participant is used to measure the race record, or each lap time or time for passing a final point can be measured manually or automatically. The race record of a participant measured as above is input to database (S52). Here, records of a participant are input to database according to indexes, such as participant, lap, name, or mobile phone number, so that the input record data can be easily searched in a format that a manager wishes to output. Next, when there is a command to transmit record data to a mobile phone of a race participant according to instruction of the manager in Step S54, a race record is searched from the database (S56). During searching the race record, not only a race completion record but also records of lap times can be searched. Here, IDs of race participants are simultaneously searched and telephone calls are automatically made to mobile phones of the participants so that record data of each participant is transmitted (S58).

As described above, in the present invention, race records can be transmitted to a mobile phone of a participant, or expected passing/arrival time by lap is calculated based on the record of the participant at one point and the participant can be informed of the calculated time. That is, when a running speed and lap time at 5 km point is measured and transmitted to the management server 22, the management server 22 calculates expected passing/arrival time for each of 5 km laps such as 10 km, 15 km, 20 km, 25 km, 30 km, and 35 km and informs the participant of the calculated expected time. Accordingly, additional service of informing those interested in the race records of participants other than the participants of race record data can be provided for free or by payment. In this case, a race participant pays addition fees according to the number of mobile phones to receive the record data assigned in advance, the fee may be charged in a manner of post payment, or the fee can be paid by a race record transmitting sponsor.

Figure 6:
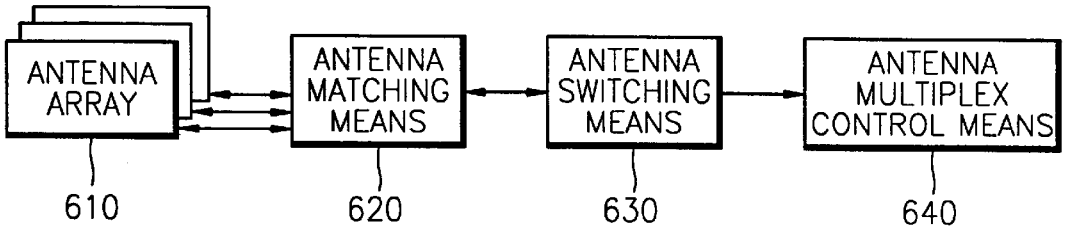
FIG. 6 is a block diagram showing a radio frequency means adopted in the present invention.
Figure 7:
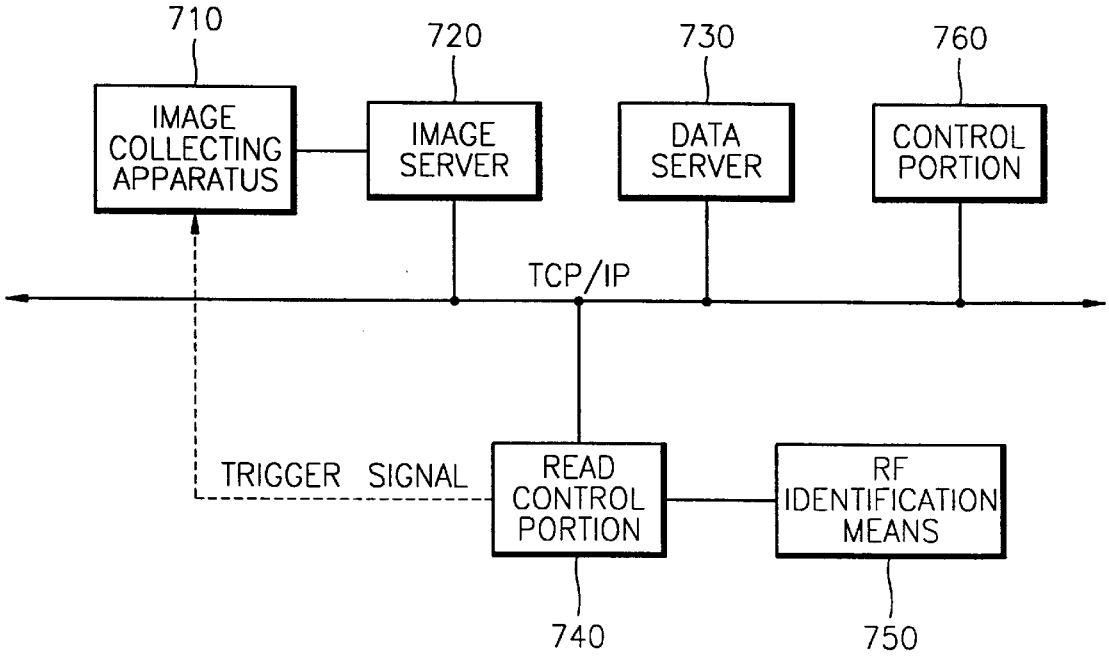
FIG. 7 is a block diagram showing a record measurement system using image and radio frequency identification.

FIGS. 6 and 7 show a record measurement system using RF identification by using an image photographing apparatus according to the present invention. FIG. 6 shows the structure of an RF identification means adopted in the present invention. Referring to the drawing, an RF identification means includes an antenna tag (not shown), an antenna array 610, an antenna switching means 630, an antenna matching means 620, and an antenna multiplex control means 640.

The antenna tag includes an antenna and a microchip therein and the microchip has a predetermined ID. The antenna array 610 used in various ways has functions of distinguishing an edge signal and a main signal, increasing a range of identification, and recognizing each of multiple points. The antenna array 610 constituting a wireless transceiving apparatus.

The antenna matching means 620 matches antenna arrays having different impedance properties. The antenna switching means 630 connects or disconnects an antenna selected by an antenna multiplexer (not shown). The antenna multiplex control means 640 controls how to operate which of the antennas.

FIG. 7 shows a record measurement system using image and RF identification. Referring to the drawing, a record measurement system using image and RF identification includes a RF identification means 750 including an antenna tag, a read control portion 740, a data server 730, an image collecting apparatus 710, an image server 720, and a control portion 760.

The RF identification means 750 identifies an ID of an antenna tag as described with reference to FIG. 6. The read control portion 740 receives and controls an intrinsic identification ID of each object through the RF identification means 750, processes and stored the received intrinsic identification ID, and wirelessly transmits the processed data to a desired destination. Here, the intrinsic ID of an antenna tag is read by the RF identification means 750 and a signal is transmitted to the image collecting apparatus 710.

The image collecting apparatus 710 is a means for photographing an image and, for example, a digital camera or an analog camera such as a CCTV camera is used therefore. When the camera is an analog camera such as a typical CCTV camera, continuing photographing is possible without a trigger signal. Since the image quality of the CCTV camera is not superior, it is not used in the case in which fine and clean image quality is requested. However, in the case of a digital camera, photographing can be performed by a trigger signal so that an image at a higher resolution than that of a typical CCTV camera can be obtained.

The image server 720 connected to the image collecting apparatus 710 stores image photographed by a camera. The image server 720 processes a signal and data received from the read control portion 740 and the image collecting apparatus 710 and generates database.

The control portion 760 can real time monitoring and control the above apparatus and performs processing and outputting monitored data.

The operation of an object identification and measurement apparatus using image and RF identification as a record measurement system using RF identification is described in detail as follows.

When an object such as a person wearing an antenna tag passes, a tag ID signal received by the RF identification means 750 is read by the read control portion 740. The read control portion 740 generates a signal and transmit the signal to the image collecting apparatus 710. Then, a camera photographs an image and transmits data to the server 720. In this case, if the image collecting apparatus 710 is a digital camera, part of an image is stored by a trigger signal and part of instantaneous image and the tag ID signal output from the read control portion 740 are matched and received through a network and stored in the data server 730. when the image collecting apparatus 710 is an analog camera such as a CCTV camera, continuous image matched with the tag ID are received through a network and stored in the data server 730.

In the above camera photographing only part of an image by trigger signal, various frames from the minimum 1 to 100 fps (frame per second) the number of frame can be used.

Reading the tag ID received from the RF identification means 750 and matching the read tag ID with the photographed (detected) image and storing the same in the data server 730 are performed by the read control portion 740.

In the control portion 760, information stored in the data server 730 by matching the tag ID signal and image data can be conveniently and freely controlled and used by monitoring the information and processing and outputting the same as needed.

While this invention has been particularly shown and described with reference to preferred embodiments thereof, it will be understood by those skilled in the art that various changes in form and details may be made therein without departing from the spirit and scope of the invention as defined by the appended claims.

For example, an infrared sensor or other detecting sensors may be configured and operated together so that a person or object not wearing the antenna tag can be detected and monitored through an image.

As described above, in the service system and method for transmitting race record or expected passing/arrival time to a mobile phone as the record measurement method and system using RF identification according to the present invention, since a participant of a race automatically receives the race record on the mobile phone the participant assigned without checking the race record through the Internet or by a telephone, informing the participant of a race record is smoothly, rapidly, and accurately performed. Also, since a sponsor who transmits a race record through a mobile phone can advertise or promote the service technology of the present invention targeting specific persons, the above method and system can be used as a means for advertising a brand name of a company.

Also, according to the present invention, by identifying an object in combination of the ID signal of an antenna tag and the image data, accuracy and reliability in identification of an object is improved.

That is, while the conventional infrared sensor detects only the presence of an object, since the identification of an object can be detected in the present invention, it is obvious that the present invention can be applied to various fields and will bring diverse remarkable effects.

For example, in particular places such as an area needing a security service for preventing burglary, an unmanned monitoring zone, a zone where entrance of a human is not allowed, a place where unmanned monitoring is needed during off duty hours, and other places needing monitoring by a camera for 24 hours or a camera turned on/off by a sensor, a person or object passing the above places can be monitored and an image can be stored.

In another example, when a person appears, a conventional camera for a cash dispenser (CD) in a bank is operated to take a photograph and the photographed image is stored. In contrast, in the RF identification apparatus and image collecting apparatus according to the present invention are simultaneously installed, an image can be photographed from the moment when a CD card is inserted and read so that storing unnecessary image information can be prevented.

When the present invention is applied to sports games, while an image is recorded by means of a VTR and the recorded image is edited and analyzed, according to the present invention, database is established in a host computer for integrated database and the record data is collected and totalled. Thus, when the present invention is applied to marathon or track games, the order of race participants passing the final point can be checked by using the RF identification and automated photographing and confirmed by real time broadcasting.

Also, the present invention can be used in various industrial fields in which a particular object is identified in a predetermined area and the circumstances are photographed and stored.

What is claimed is:

1. A method of transferring a footrace racer's record data based on RF identification of the racer, the method comprising:

storing in a database a telephone number of a mobile telephone designated by a specific racer;

determining an ID of the specific racer and a record of passing time of the specific racer at a measurement point by receiving an ID signal output from an antenna tag attached to the specific racer and driven by a wireless power signal generated by an antenna array at the measurement point, when the specific racer reaches the measurement point;

using a plurality of antenna arrays at the measurement point, receiving a plurality of ID signals output from a plurality of antenna tags of respective racers, identifying the specific racer upon receiving the ID signal of the antenna tag of the specific racer, obtaining personal data of the specific racer having the ID corresponding to the ID signal, and a passing time record of the specific racer at the measurement point, and storing the personal data and passing time of the specific racer in the database, automatically reading out the personal data and the passing time record of the specific racer stored in the database, and transmitting the personal data and the passing time record of the specific racer; and reading a telephone number a mobile telephone stored in the database and transmitting a message including the passing time record to the mobile phone by making a telephone call through a management server managing the database, at an instant in time when the specific racer reaches the measurement point.

2. The method as claimed in claim 1, wherein the message is a voice message.

3. The method as claimed in claim 1, wherein, when the message is transmitted, also transmitting an advertisement or promotion message.

4. The method as claimed in claim 1, further comprising making an image of the specific racer for a period from the point when the specific racer reaches the measurement point, wherein the management server matches the image and the specific racer and stores a match result in the database.

5. The method as claimed in claim 4, including making a digital or analog image of the specific racer.

6. The method as claimed in claim 1, wherein the message is a text message.

7. A system for transferring a footrace racer's record data based on radio frequency (RF) identification of the racer, the system comprising:

a record collecting apparatus including a plurality of antenna arrays generating wireless power signals at a measurement point, receiving identification (ID) signals output from antenna tags attached to a plurality of racers, one of the antenna arrays receiving the ID signal output from the antenna tag of a specific racer and driven by the wireless power signal when the specific racer reaches the measurement point, and determining and outputting an ID for the specific racer, corresponding to the ID signal received, and a passing time record for the specific racer at the measurement point;

a database in which the ID of each antenna tag, a telephone number of a mobile telephone designated by the specific racer, personal data of the specific racer having the corresponding antenna tag, and the passing time record for the specific racer at the measurement point, determined and transmitted by the record collecting apparatus, are stored;

a management server for storing the telephone number of the mobile telephone designated by the specific racer, for storing the personal data and passing time record for the specific racer determined and transmitted by the record collecting apparatus, in the database, and for automatically reading out and transmitting the telephone number of the mobile telephone, the personal data, and the passing time record of the specific racer stored in the database; and a modem for transmitting a message including the passing time record of the specific racer, through which the management server makes a telephone call to the telephone number of the mobile telephone designated by the specific racer at an instant in time when the specific racer reaches the measurement point.

8. The system as claimed in claim 7, wherein the message is a voice message.

9. The system as claimed in claim 7, wherein, when the message is transmitted, an advertisement or promotion message is included in the message.

10. The system as claimed in claim 7, further comprising an imaging apparatus for making an image of the specific racer when the specific racer reaches the measurement point, and wherein the management server matches the image and the specific racer and stores a match result in the database.

11. The system as claimed in claim 10, wherein the imaging apparatus is a digital camera or an analog camera.

12. The system as claimed in claim 10, wherein the imaging apparatus is a digital camera that makes an image according to a trigger signal generated by the record collecting apparatus, and that is instantaneously and partially stored by the management server.

13. The system as claimed in claim 10, wherein the imaging apparatus is an analog camera that makes images continuously without a trigger signal and that are stored by the management server.

14. The system as claimed in claim 7, wherein the record collecting apparatus comprises:

an antenna switching unit for selecting the ID wireless signal through the plurality of antenna arrays;

an antenna matching unit for matching impedance between the antenna arrays and the antenna switching unit; and an antenna multiplex control unit for switching in response to a switching signal of the antenna switching unit and selectively transmitting an ID wireless signal of each antenna tag through the antenna matching unit.

15. The system as claimed in claim 7, wherein the message is a text message.

* * * * *